United States Patent [19]

Wilson

[11] 4,308,954

[45] Jan. 5, 1982

[54] PLASTIC NESTABLE-STACKABLE RECEPTACLE

[76] Inventor: James D. Wilson, 421 Vista Suerte, Newport Beach, Calif. 92660

[21] Appl. No.: 123,663

[22] Filed: Feb. 22, 1980

[51] Int. Cl.[3] ..... B65D 21/04

[52] U.S. Cl. ..... 206/505

[58] Field of Search ..... 206/505, 506, 507, 501; 211/126

[56] References Cited

U.S. PATENT DOCUMENTS 3,082,879 3/1963 Wilson ..... 206/505

3,405,810 10/1968 Rogus ..... 206/507

*Primary Examiner*—George E. Lowrance

*Attorney, Agent, or Firm*—Keith D. Beecher

[57] ABSTRACT

A receptacle is provided for transporting, storing and displaying bakery, and other products. The receptacle is constructed so that it may be stacked on or nested into other like receptacles without any need to slide or rotate the receptacles with respect to one another; so that the receptacles may be conveniently stacked by automatic equipment at the bakery, and stacked or nested on route trucks where space is at a premium.

3 Claims, 5 Drawing Figures

PLASTIC NESTABLE-STACKABLE RECEPTACLE

BACKGROUND

The receptacle of the present invention may be formed, for example, of plastic or sheet metal, and it is constructed so that it may be stacked on other like receptacles when filled with products, or nested down into like receptacles when empty so as to conserve space. The receptacles of the invention are intended primarily for use in the food industry, although they have general application in a wide variety of plants, warehouses, transportation vehicles, and the like.

The receptacles of the invention may be used, for example, in transporting and displaying bakery, or other, goods. For example, a plurality of receptacles may be loaded with bakery goods at the bakery and stacked on top of one another, and they may then be transported in a stacked condition to the retail store or market. The stacked receptacles may then be positioned on the floor of the store or market so that the merchandise therein may be displayed and purchased. When the receptacles are empty, they may be nested down into one another for space conservation purposes, and then returned to the bakery.

The particular nestable and stackable receptacle of the present invention is advantageous in that it is capable of being nested or stacked without the need for moving bails or other movable parts, and without the need to slide or rotate the receptacles with respect to one another. Moreover, the improved receptacle to be described nests and stacks with like receptacles in vertical alignment for optimum space conservation.

The receptacle of the invention preferably is formed of molded plastic, such as injection molded polypropylene, so as to be light, rugged, and inexpensive in its construction. As will be described, the receptacle is capable of being stacked with other like receptacles into a rigid and stable tier; and of being nested within the like receptacles, also as a rigid and stable tier; all without any need to slide or rotate the receptacle with respect to other receptacles in the tier.

The receptacle of the invention is constructed so that merchandise therein may be readily accessible when the receptacle is stacked into a tier with other like receptacles, the merchandise being removable from the open ends of any of the receptacles in the tier without disturbing the other receptacles.

A particular unique feature of the receptacle of the present invention is that it may be stacked on, or nested in, other like receptacles, by means of a simple operation, without any need to rotate or slide the receptacle relative to the other receptacles in the tier, and even when the top of the tier on which the receptacle is loaded is partially obstructed. This feature is particularly advantageous when it is desired to stack or nest the receptacles while they are in the route truck, as mentioned above, where space is limited.

The receptacle of the present invention is of the same general type as the receptacles described and claimed in U.S. Pat. Nos. 3,219,232; 3,398,840; and 3,608,921, all of which have issued in the name of the present inventor.

DETAILED DESCRIPTION OF THE ILLUSTRATED EMBODIMENT

Figure 1:
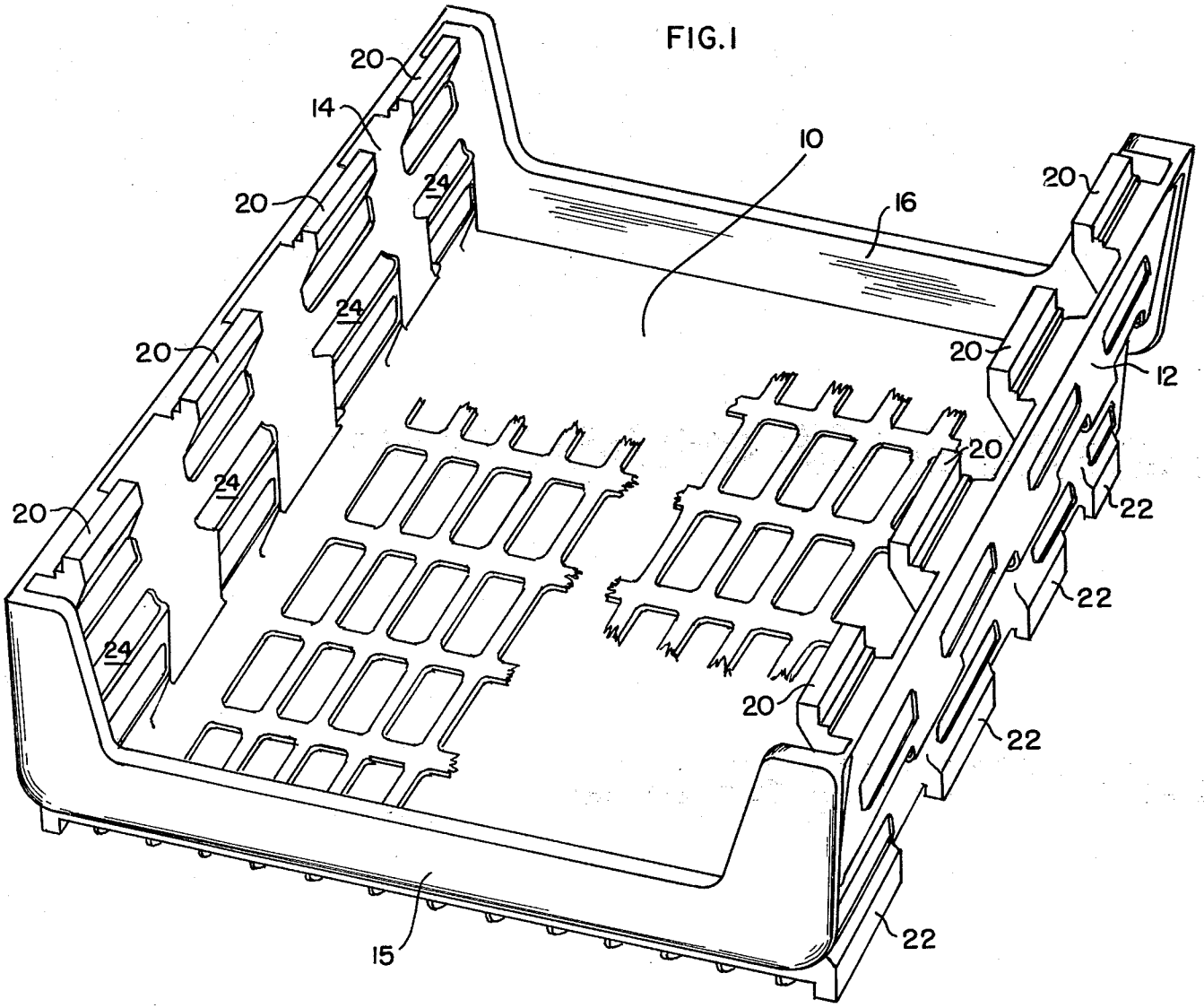
FIG. 1 is a perspective representation of a receptacle constructed in accordance with the invention.
Figure 2:
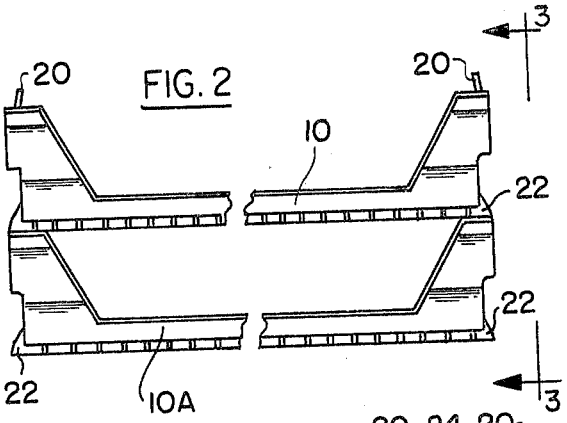
FIG. 2 is an end view showing two such receptacles stacked on top of one another.
Figure 3:
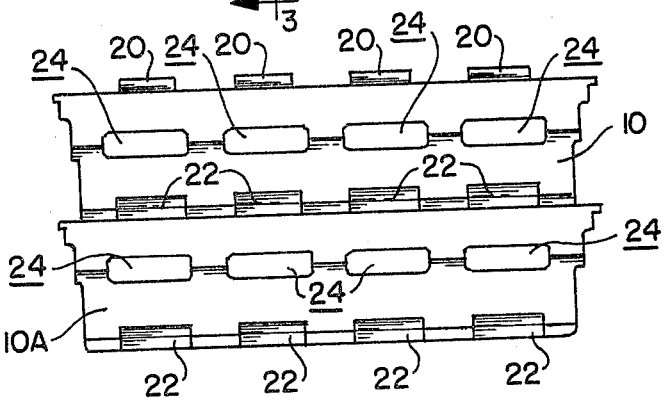
FIG. 3 is a side view taken along the line 3—3 of FIG. 2.
Figure 4:
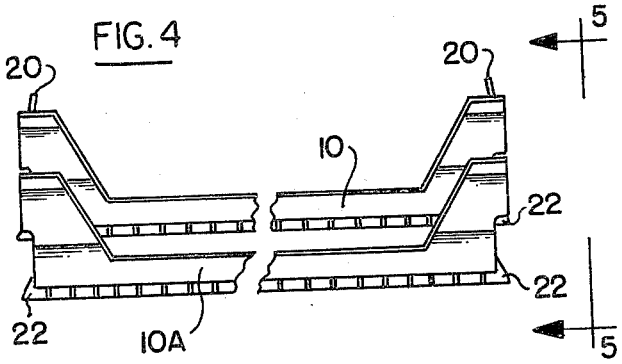
FIG. 4 is an end view showing two such receptacles nested into one another.
Figure 5:
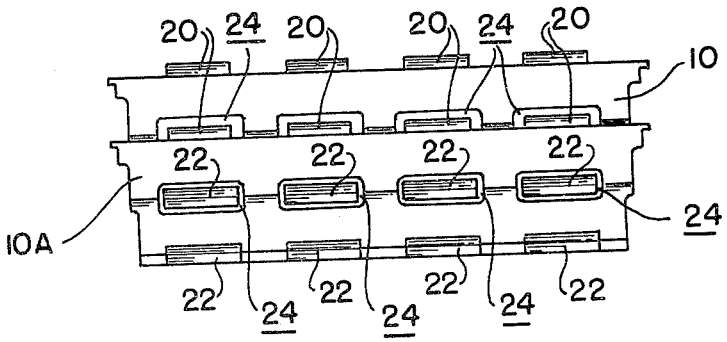
FIG. 5 is a side view taken along the line 5—5 of FIG. 4.

The receptacle shown in FIG. 1 of the the drawings, as mentioned above, is adapted to be stacked on top of a like receptacle as shown in FIGS. 2 and 3, or nested into the like receptacle as shown in FIGS. 4 and 5. The receptacle is preferably molded as a single integral unit to be formed of an appropriate plastic material such as polypropylene and formed by injection molding techniques.

The receptacle, as shown in FIG. 1, includes a bottom 10, a pair of side walls 12 and 14 integral with the bottom, and end walls 15 and 16 integral with the bottom and joining the walls, the end walls being of reduced height as compared with the side walls to permit access to the receptacle when other like receptacles are stacked on top of it. The receptacle, as illustrated, may have a multiplicity of apertures therein so as to reduce the weight as much as possible.

The side walls 12 and 14 each have nesting and stacking means formed on the inner and outer surfaces thereof. The stacking means comprises a plurality of upwardly extending projections 20 formed on the top edge of each side wall, and extending along the edge in spaced relationship with one another. The projections 20, in each instance, are displaced inwardly from the plane of the corresponding side wall. The stacking means further comprises a like plurality of downwardly facing shoulders 22 formed at the lower edge of each side wall 12 and 14; the shoulders being vertically aligned with corresponding ones of the projections 20.

To stack the receptacles on top of one another, a like receptacle is merely placed on top of the receptacle of FIG. 1, with its lower shoulders 22 receiving and resting on corresponding ones of the upper projections 20 of the receptacle of FIG. 1, as shown in FIG. 2. The inner surface of each shoulder 22 is shaped to receive and encompass the corresponding projection 20 of a lower receptacle so that the two receptacles are stacked on top of one another in a stable tier.

A like receptacle may be nested down into the receptacle of FIG. 1 by tilting the like receptacle slightly from a horizontal position so that its shoulders 22 on one of its side walls may be inserted in slots 24 in the side wall 12 or 14 of the illustrated receptacle. As illustrated, slots 24 are formed in inwardly extending sections of the side walls and face upwardly towards the open top of the receptacle. Then, as the like receptacle is turned to a horizontal position, shoulders 22 on its other side wall will be inserted into corresponding slots in the other side wall of the illustrated receptacle. After the simple manipulation the like receptacle is supported on the inner edges of slots 24 in nested relationship with the illustrated receptacle, as shown in FIGS. 4 and 5.

The receptacles may also be stacked on top of one another in a longitudinally offset relationship and the resulting tier may be supported in a tilted position, such as illustrated and described in U.S. Pat. No. 3,082,879. In this manner the products in the individual receptacles move to the forward end of each receptacle by gravity feed as the products are removed.

An important feature of the receptacle of the invention is the fact that it may be manipulated easily and smoothly to stack it on top of a like receptacle, or to nest it down into the like receptacle. Another feature of the receptacle is its simplicity, so that it may be molded at a relatively low cost.

While a particular embodiment of the invention has been shown and described, modifications may be made. The following claims are intended to cover the modifications which come within the spirit and scope of the invention.

What is claimed is:

1. A receptacle adapted to be stacked and nested with a like receptacle, said receptacle comprising: a bottom; a pair of side walls integral with said bottom each of said side walls having a lower portion and an upper portion, with the lower portion being displaced inwardly from the upper portion; a plurality of discrete upwardly extending projections formed on the upper edge of each of said side walls displaced inwardly from the plane of the upper portion of such side wall and positioned thereon at spaced locations therealong; a plurality of discrete downwardly facing shoulders formed on the outer surface of each of said side walls at the lower edge of each of said side walls in vertical alignment with respective ones of the projections to be received on the projections of a like receptacle when the receptacle is stacked on the top of the like receptacle; and each of said side walls being configured to define a plurality of upwardly-facing slots at the border of the upper and lower portion of such side wall in vertical alignment with respective ones of the projections and displaced downwardly from the projections towards said bottom to receive the shoulders of the like receptacle when the like receptacle is nested into the receptacle with the inner edges of the slots forming a support for the like receptacle.

2. The receptacle defined in claim 1, and which includes end walls integral with said bottom and with said side walls and having a reduced height compared with the height of the side walls.

3. The receptacle defined in claim 1, in which the inner surface of each of said shoulders is configured to receive and encompass the corresponding one of the projections and a like receptacle when the like receptacle is stacked on the receptacle.

* * * * *